United States Patent [19]

Collins

[11] Patent Number: 4,775,348

[45] Date of Patent: Oct. 4, 1988

[54] BUBBLE MACHINE

[76] Inventor: Phillip A. Collins, 1623 Varnum Street, N.W., Washington, D.C. 20011

[21] Appl. No.: 3,293

[22] Filed: Jan. 14, 1987

[51] Int. Cl.[4] ..... A63H 33/28

[52] U.S. Cl. ..... 446/16; 446/15

[58] Field of Search ..... 446/16, 15, 18, 21, 446/17, 19, 20; 261/83, DIG. 26

[56] References Cited

U.S. PATENT DOCUMENTS

| | | | |
|---|---|---|---|
| 3,601,313 | 8/1971 | Berg | 261/DIG. 26 X |
| 3,814,394 | 6/1974 | Murray | 446/15 X |
| 4,045,049 | 8/1977 | Schultz | 446/15 X |
| 4,423,565 | 1/1984 | Bart | 446/16 |

OTHER PUBLICATIONS

European Patent Applicaton, Publication No. 0082233, Jun. 1983, Leardini.

*Primary Examiner*—Mickey Yu
*Attorney, Agent, or Firm*—Lalos & Keegan

[57] ABSTRACT

A bubble forming machine that produces bubbles including a housing having an air inlet and an air and bubble outlet, a fan to create an air stream through the housing from the inlet to the outlet, a reservoir containing a bubble creating liquid such as soapy water located in the housing in the air stream near the outlet and open at the top so that air moves across the open top of the reservoir, a plurality of foraminous screens radially mounted on a rotating axis. The screens have a multiplicity of openings therein and are mounted for movement into and out of the reservoir opposite to the direction of air flow. A motor is provided for rotating the axis and thereby the screens into and out of said reservoir so that the screens pick up some of the soapy water to form a film on the openings in the screen that is blown off by the air stream to form a stream of bubbles.

In an embodiment suitable for use in a disco, the bubble machine is provided with a bracket to mount to a ceiling so that the housing of the bubble machine can be mounted thereto and rotate horizontally through 360 degrees by a motor connected with the housing. The bubbles are then able to be distributed through 360 degrees.

In a toy embodiment, a battery or other source of power is provided for driving the axis of the screens. The power is controlled through a pistol grip handle onto which the housing is mounted, and which includes a switch is in the form of a trigger.

29 Claims, 2 Drawing Sheets

BUBBLE MACHINE

BACKGROUND OF THE INVENTION

The use of bubble machines is well known in the art and is desired for a variety of different reasons. One is for the novel effect that attracts instant attention for use intermittently in discos. In can be used, for instance, with a rotating mirror ball, so common and popular in many discos. The impact to the viewer is best when the colored lights from the mirror ball are enhanced with colorful bubbles from the machine entering the dance floor area in the vicinity of the mirror ball. Another use of such machines is as amusement devices, which are particularly appealing to young children. Also, such machines are readily adapted to use for advertising purposes. For instance, a particular bubble machine can be enclosed within an enlarged replica of a drinking glass or the like, and made to simulate an effervescent beverage.

Bubble machines of various types are known. They have provided for carrying films of liquid adapted to form bubbles through a current of air so that bubbles are formed from the liquid, but these are provided as separate units or are comparatively complicated so that they are not adapted for universal use. Bubble machines of this type, generally have a bath of bubble forming liquid, a source of air for making the bubble, and a disk with holes in the outer portion thereof in a circle. As the disk turns, different individual openings are filled with the film and the air blowing through the openings then forms these films into bubbles. These have been both manually and motor operated.

BRIEF SUMMARY OF THE INVENTION

The present invention is a comparatively simple housing or casing having a solution holding compartment provided with rotating walls and a fan to provide a stream of air to move therethrough. However, whereas in the past machines, the bubble forming devices have been openings formed in disks that rotate within their own plane, the present invention provides bubble making walls or screens that rotate transverse to the air flow. There are several walls together in a star fashion or pattern that rotate about an axis, which is the center of the star. Thus, the walls do not rotate within their own plane but rather rotate at an angle to their planes and perpendicularly to the air stream created by the fan.

The object of the present invention is to provide a bubble machine that is simpler to operate and more flexible in the types of bubbles produced. This invention provides for different bubble makers to be used, some which have only large openings for large bubbles, some which have only small openings for small bubbles, and others with mixed openings for both large and small bubbles for forming a variety of sizes of bubbles at the same time.

The device makes bubbles of all shapes and sizes in a simple and unique method. It is very easy to use and requires no physical movement of the uses. The bubble machine of the present invention makes bubbles of all sizes depending upon the openings in the wall immersed into the liquid reservoir within the machine. The bubble machine makes many bubbles constantly while fascinating the many people who enjoy viewing the emerging bubbles and the beautiful colors seen in them. It is also designed as a simple bubble producing toy for children to enjoy.

Such a device is also useful for disco clubs where the machine may be mounted to the ceiling in the vicinity of the typical rotating mirror to provide much more color to the dance floor with a constant stream of bubbles sparkling with different colors.

A reservoir or bath of soapy water or some other bubble making liquid is recommended to be used with the present invention. The rotating walls or foraminous screens are immersed into the soapy liquid by a power means such as a motor that turns the walls at a constant slow speed so that the walls move through the soap bath and openings in the walls pick up and are filled with soapy water. The walls rise into the air stream path of a fan means including a high speed fan that blows air through the soapy film held in the openings in the walls. The air stream is strong enough to overcome the adherence of the soapy film to the openings in the wall. The film is released from the wall to combine in spherical shapes as bubbles. There are different walls with differing openigns to provide for different size bubbles. Also, there is an air flow door that allows directing of the bubbles to go to different places.

A bubble machine includes fan means and the rotatable radially extending walls to move through the bubble solution held in the reservoir. The fan causes bubbles to be formed within the machine, with the bubbles being forced outwardly through a door that determines the direction of the travel of the bubbles.

Hard, molded plastic may be used for the outer housing or casing of the bubble making machine with one side having an adjustable opening door and another side to admit air ingress. A small tub on the bottom will serve as a reservoir and hold a sufficient amount of a mixture of soap and water. A power means including a motor with four rotatable screens is used to stir up the soap and produce bubbles. A hard rectangular piece of smooth plastic is connected at the base of the housing by a hinge to form a door. This door is used to guide the bubbles upwardly after being formed. The bubbles and soapy water are directed towards the door with the use of a fan. This fan is placed on the side across from the door. This side is also open around the fan to allow for the air to pass through to the door to push the bubbles outwardly and upwardly. The rotating screens and the fan are to operate simultaneously and continuously to produce bubbles. They may be powered electrically at any electrical outlet, or by batteries. The present invention may be constructed so as to be safely used by children although the prime use for the bubble machine is not necessarily as a child's toy since it is useful in places of entertainment or even filmmaking for interesting backgrounds and in places where a particular mood is to be set.

DETAILED DESCRIPTION OF THE DRAWINGS

Figure 1:
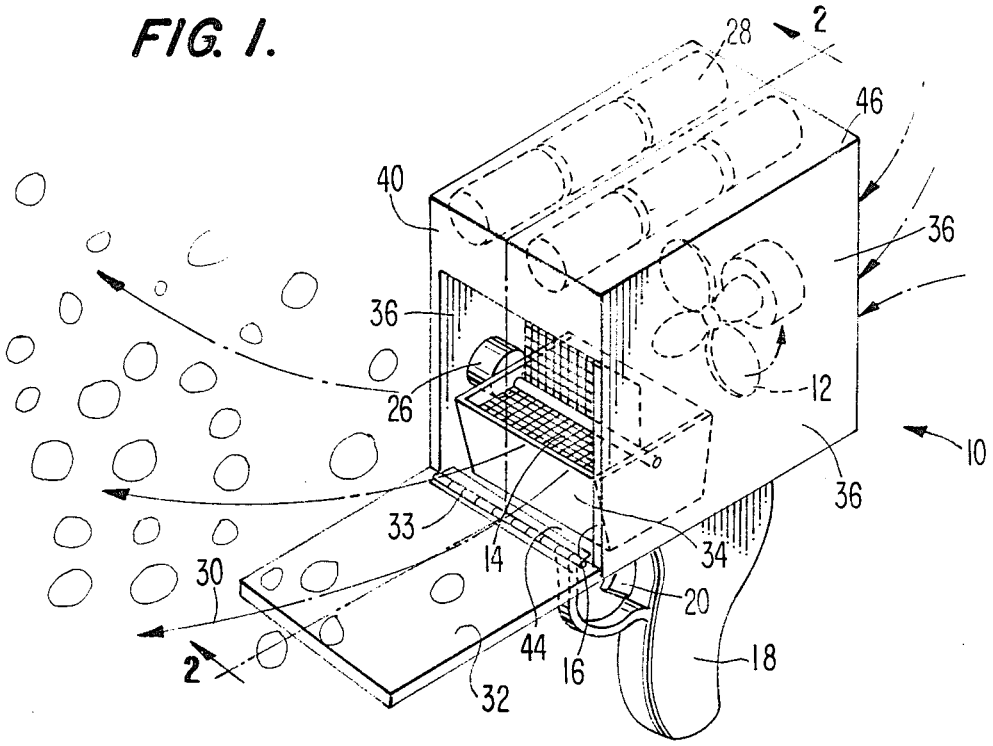
FIG. 1 is a perspective view of one type of bubble machine of the present invention that operates on batteries and illustrating the flow of air and bubbles.

The bubble machine is generally constructed of a housing 10 in which the fan 12 for creating an air stream flow and the bubble maker 14 are located. The arrangement provides the liquid film forming bath to be near the outlet opening 16 in the housing 10 for the bubbles to be released. The bubble former 14 includes a plurality of walls or foraminous screens 15 rotatably mounted for movement through the bath during which the liquid, through which the walls pass, forms a film that covers the openings in the screen 15. As the screen with the film on it moves out of the bath and into the air stream created by the fan 12, the film is forced from the screen to form bubbles that exit through the outlet 16 in the housing 10.

This embodiment is intended to be used as a portable unit, and therefore, the housing 10 is mounted on a pistol grip handle 18 with a movable trigger 20. The device is held by the user gripping the handle and with his index finger in position to pull the trigger to actuate the device. When the trigger 20 is pulled, a contact 22 completes the circuit in which both motors 24 and 26, for the 12 fan and the rotating screens 15 respectively, are located and connects them to the batteries 28. The completed circuit causes both the fan to rotate and create an air stream 30, and the screen motor 26 to rotate to bring the bubble maker into and through the bath and then above the bath with the film on it. The film is loosened from the screen as the air passes through the openings in the screen 15 and moves into the air stream to form the bubbles.

As shown in FIG. 1 there are six batteries 28, but this number will depend upon the size and type of motors that are used. There is a door 32, hinged at the bottom at 33 to be swung open or closed, located in the outlet 16 for the bubbles. This door 32 is placed into its open position when the trigger 20 is going to be pulled so that the bubbles formed can leave the device and move into the surrounding air. The more door 32 is moved toward a closed position the more it will force the bubbles leaving the device to be directed upwardly.

The housing 10 is formed having two side walls 36, a back wall 38, a front wall 40 with the outlet 16 in it, a bottom 44 and a top 46. The back 38 of the housing may be a screen-like material or a plate with many slit-like openings in it to allow air to flow into the housing from the back as the fan is rotated. The power means, in the form of motor 26, operates the bubble maker that moves its walls through the bath. The motor is geared to move relatively slowly to provide enough time for the liquid to form a film over the entire set of openings in the wall and to have the transit time within the air stream to be sufficiently long that the air will form all of the film into bubbles.

Figure 7:
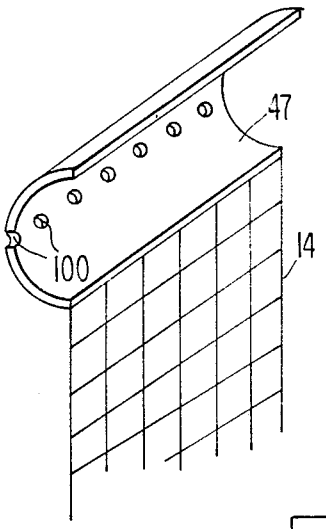
FIG. 7 is a broken away perspective view of one wall having a scoop.

Scoops 47, secured to the radially extending end of each screen 15 may be optionally added to pick up more soapy liquid and pour it down the leading face of the screen to produce a greater number of bubbles. The scoops 47 may also be provided with small holes 100 in the bottom thereof to permit the liquid to run down the trailing face of each screen or wall 15 as shown in FIG. 7.

Figure 2:
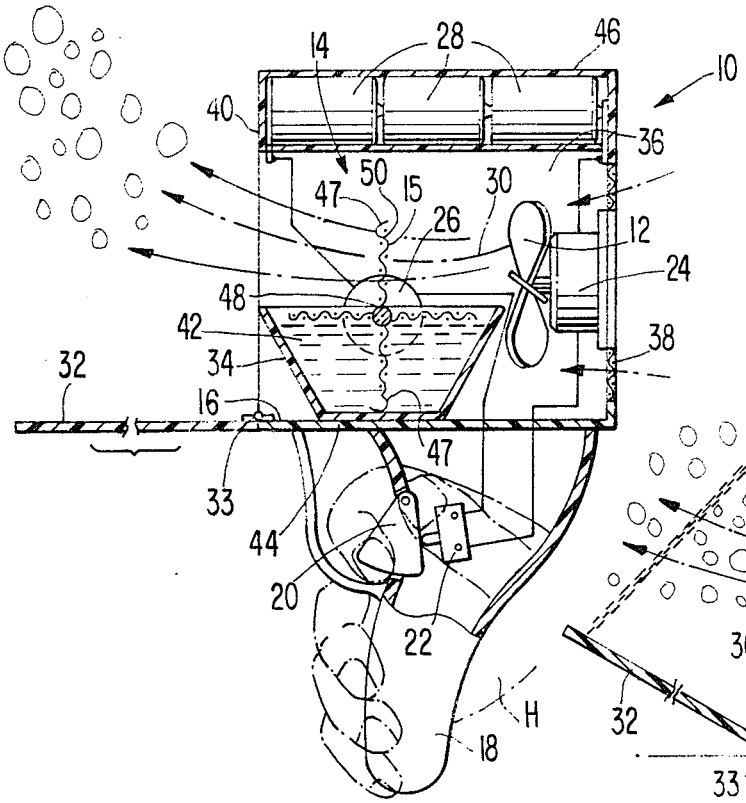
FIG. 2 is a cross-sectional view taken substantially along the plane defined by reference line 2—2 of FIG. 1.

As shown in FIG. 2, a hand H is shown in phantom lines and the path of the air stream and the bubbles through the machine is indicated by arrows. Thus, in operation, when the trigger finger pulls the trigger, switch 22 is closed and completes the circuit in which the fan motor 24, the wall motor 26 and the batteries 28 are located. As shown, the cicuit is connected in series. As the fan 12 rotates, an air stream 30 is created forcing air to flow through the back 38 of the housing and then over the top of the reservoir 34 holding the bath 42 of bubble forming liquid that is picked up by the walls or screens 15 to form a film thereon, and thereafter the bubbles are blown through outlet 16. At the same time, the motor 26 for the walls 15 is energized and slowly rotates the spindle 48 onto which the walls or screens 15 are radially mounted. The mounting thereof is as radials of a circle having four walls or screens 15 in the embodiment of FIGS. 1 and 2. The rotation of the spindle 48 slowly moves the walls or screens through the bath 42 and then into the air stream 30 in the opposite direction as the air flow 30, rather than in a plane transversely across the air flow, as most prior art machines operate. When rotating in this direction, the scoop 47 will gradually empty only to leading face of the screen while some liquid will also flow over the trailing face due to the presence of the holes in the scoops.

As the spindle 48 rotates the walls 15 are each moved so that when the top 50 thereof, upon which the scoop 47 is positioned, just begins to move out of the bath and into the air stream the film on the top portion of the wall exposed to the air will gradually, as it rises above the top of the bath, being forming bubbles and as the spindle rotates there will be gradually more and more of the wall exposed to the air stream. The top 50 of the wall will soon have the film removed, but will have the wall replenished with new film due to the dual action of the scoops 47 to continuously provide bubbles until it is again moved through the bath. It should be clear that there is constantly being brought into the air stream a new wall area with fresh film for making new bubbles. In this way there is no surge of bubbles at any one time, but rather there is a constant flow of bubbles as there is a constant exposure to fresh film portions on the walls.

In the device of FIGS. 1 and 2, there are four blades and therefore as the one shown in the air stream in a vertical position moves rearwardly, the next one is having its top portion moved out of the bath laden with more bubble forming film.

Figure 3:
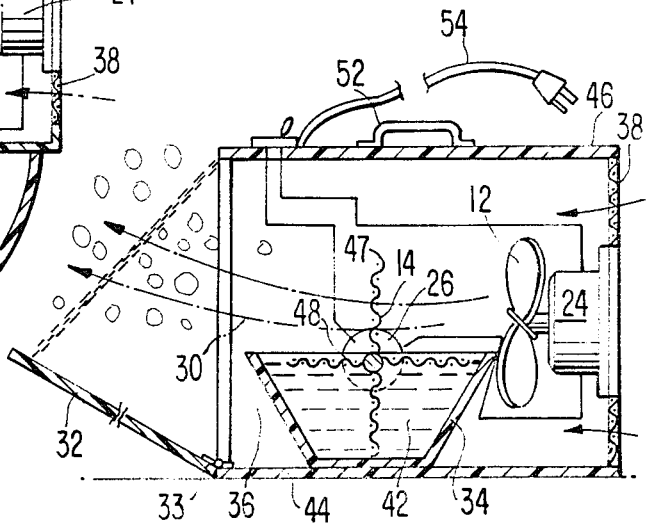
FIG. 3 is a sectional view simliar to FIG. 2 but showing another type of bubble machine that operates from an electrical line by plugging nto an electrical outlet.

FIG. 3 shows an embodiment which is intended to be plugged into line current in a house by means of power cord 54, and therefore there are no batteries as in the embodiment of FIGS. 1 and 2. The construction of the device may be similar to that of the FIG. 1 and 2 device although different motors or different power supplies are used for the machines.

Figure 4:
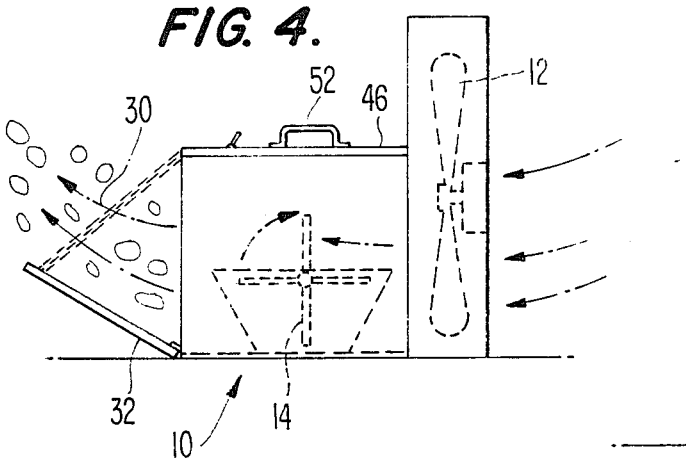
FIG. 4 is a diagrammatic side view of another type of bubble machine in which the fan blades are larger.

FIG. 4 shows an embodiment in which the fan need not be attached to the remainder of the structure and therefore can be larger than the ones already discussed. The fan has a diameter which is almost twice the diameter of the bubble making walls. In other respects, the machine is similar to the ones already described. It should be noted that both the embodiments of FIG. 3 and of FIG. 4 have a handle 52 by which the device may be carried from place to place.

Figure 5:
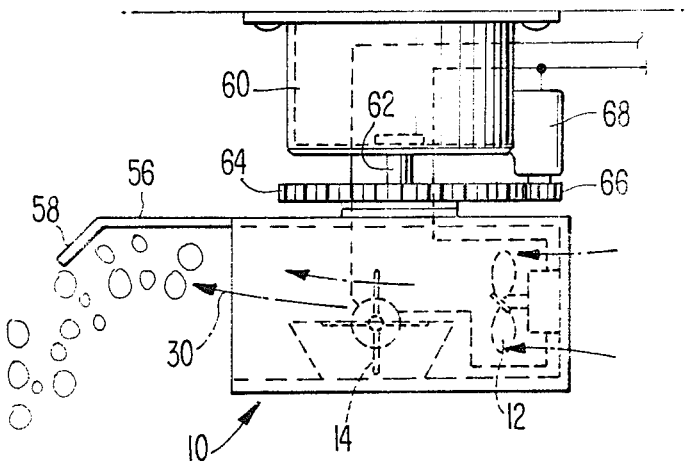
FIG. 5 is a diagrammatic top view illustrating another type of bubble machine for mounting on the ceiling.
Figure 6:
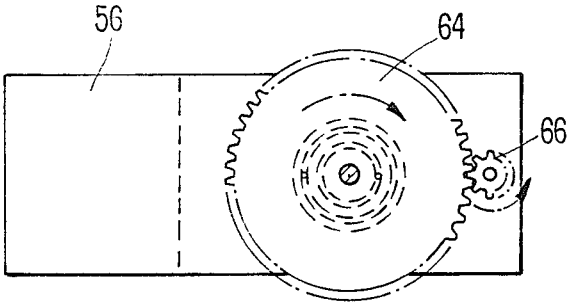
FIG. 6 is a side view of the device of FIG. 5 showing the gearing arrangement.

The embodiment shown in FIGS. 5 and 6 is intended to be mounted on a ceiling for a night club or the like. The machine 10 is mounted on the ceiling as will be explained. Most of the parts of the device are the same as in those embodiments already described. There is a baffle 56 connected at the opening, which is the exit for the bubbles, and it has a downwardly inclined flange 58 so as to urge the bubbles downwardly as they exit the machine. A bearing 60 is mounted to the ceiling by any suitable means and supports a rotatable rod 62 which is connected to a large gear 64, which is in turn, connected to the top of the machine so that the machine turns as the gear turns. An electric motor 68 is mounted to the bearing housing and drives a small gear 66 that meshes with large gear 64. Thus, as the motor 68 rotates its drive rod, small gear 66 drives large gear 64 in a clockwise direction that rotates the machine through 360 degrees continuously as long as the motor is being driven. This can provide an interesting effect especially if used together with a mirrored rotating ball.

It should be manifest that the objects of the present invention have been met with the structure of the present invention and the scope of protection for this invention should be limited solely by the following claims in which,

I claim:

1. A bubble forming machine, comprising:

a housing having an inlet and an air and bubble outlet, air stream creating means for creating an air stream through the housing from the inlet to the outlet, a reservoir for holding a bubble creating liquid located in said housing in the air stream and being open at the top so that air moves across the open top of the reservoir, and located between said air stream creating means and said outlet, a plurality of radially extending walls mounted on a spindle for rotatable movement into and out of said reservoir, each said wall having a bubble producing area located in the plane of said wall, each said bubble producing area having a multiplicity of openings within said area, drive means for moving said walls into and out of said reservoir so that each wall with its corresponding multiplicity of openings picks up some of the bubble creating liquid and after emerging from said reservoir moves oppositely to the flow of said air stream forming a stream of bubbles as the air stream moves through the multiplicity of openings in the wall.

2. A bubble forming machine as defined in claim 1, wherein said wall openings are disposed throughout the length and width of each of said walls.

3. A bubble forming machine as defined in claim 2, wherein said spindle is disposed about an axis adjacent the level of liquid in the reservoir, said walls being rotatable by said drive means for moving said walls about said axis.

4. A bubble forming machine as defined in claim 1, wherein said drive means includes a motor means for driving said walls and said air stream creating includes fan means for creating the air stream.

5. A bubble forming machine as defined in claim 1, wherein said walls are screens.

6. A bubble forming machine as defined in claim 5, wherein said screens are slightly narrower in width than the width of the reservoir.

7. A bubble forming machine as defined in claim 6, wherein said reservoir is located near said outlet.

8. A bubble forming machine as defined in claim 5, wherein the size of the openings of the screens vary across the length and width of said screen.

9. A bubble forming machine as defined in claim 4, further comprising battery means connected to said motor means and said fan means.

10. A bubble forming machine as defined in claim 4, comprising motor cord means connected to said power means and said fan means and being adapted to be plugged into an electrical outlet.

11. A bubble forming machine as defined in claim 10, further comprising means for mounting said housing onto a ceiling.

12. A bubble forming machine as defined in claim 11, wherein said mounting means includes a bracket and means for mounting said housing to rotate horizontally through 360 degrees.

13. A bubble forming machine as defined in claim 12, further comprising a housing rotation means connected with said mounting means for rotating the housing so that bubbles are distributed through 360 degrees.

14. A bubble forming machine as defined in claim 13, wherein said housing rotation means is connected to the housing through reduction gearing so that the horizontal rotation of the housing will be slow.

15. A bubble forming machine as defined in claim 3, wherein said air stream creating means includes a fan means having a fan containing blades, the length of the blades of said fan being approximately twice the height of a radially extending wall.

16. A bubble forming machine as defined in claim 1, further comprising an adjustable outlet door movably connected to said housing for directing the stream of bubbles in a particular direction.

17. A bubble forming machine as defined in claim 1, wherein said spindle is disposed on an axis, said drive means including motor means for driving said spindle and said walls about said axis, said air stream creating means including fan means having a fan for creating said air stream, said fan rotating at a much higher speed of rotation than said spindle and including switch means for controlling said motor means and said fan means.

18. A bubble forming machine as defined in claim 1, further comprising a pistol grip handle secured to said housing, and switch means including a trigger on said handle for controlling the stream of said bubbles.

19. A bubble forming machine as defined in claim 1, wherein the walls are of a length slightly shorter than the radial distance of a wall to the bottom of the reservoir.

20. A bubble forming machine as defined in claim 1, wherein the reservoir is sufficiently deep and long front to back that the walls can rotate front to back through the air stream and not contact the reservoir.

21. The bubble machine of claim 1 wherein said walls rotate in a direction toward said air flow.

22. The bubble machine of claim 1, wherein said plurality of walls are radially disposed equiangularly about said spindle and rotatable about an axis, said walls rotating in a direction toward said air flow, said drive means including motor means for driving said spindle and said walls and said air stream creating means including fan means for creating said air stream, and including an adjustable outlet door movably connected to said housing for directing the stream of bubbles in a particular direction.

23. The bubble machine of claim 1, wherein said plurality of walls are radially disposed equiangularly about said spindle and rotatable about an axis, said walls rotating in a direction toward said air flow, said drive means including motor means for driving said spindle and said walls and said air stream creating means including fan means for creating said air stream, and including an adjustable outlet door movably connected to said housing for directing the stream of bubbles in a particular direction means for mounting said housing onto a ceiling, said mounting means includes a bracket and means for mounting said housing to rotate horizontally through 360 degrees, and a housing rotation means connected with said mounting means for rotating the housing so that bubbles are distributed through 360 degrees.

24. The bubble machine of claim 1, wherein said plurality of walls are radially disposed equiangularly about said spindle and rotatable about an axis, said walls rotating in a direction toward said air flow, said drive means including motor means for driving said spindle and said walls and said air stream creating means including fan means for creating said air stream, including a pistol grip handle secured to said housing and switch means including a trigger on said handle for controlling the stream of said bubbles, and battery means connected to said motor means and said fan means.

25. The bubble machine of claim 1 including, scoops secured to the walls to provide additional liquid to form bubbles, each scoop being defined by a substantially continuous surface.

26. The bubble machine of claim 1, wherein said plurality of walls are radially disposed equiangularly about said spindle and rotatable about an axis, said walls rotating in a direction toward said air flow, said drive means including motor means for driving said spindle and said walls and said air stream creating means including fan means for creating said air stream, an adjustable outlet door movably connected to said housing for directing the stream of bubbles in a particular direction, means for mounting said housing onto a ceiling, said mounting means includes a bracket and means for mounting said housing to rotate horizontally through 360 degrees, a housing rotation means connected with said mounting means for rotating the housing so that bubbles are distributed through 360 degrees, and scoops secured to the walls to provide additional liquid to form bubbles.

27. The bubble machine of claim 25, wherein each scoop is provided with small holes in the bottom thereof to permit the liquid to run down the trailing face of each wall.

28. The bubble machine of claim 1, wherein said air stream creating means creates an additional air stream along an outside surface of said housing in the same direction as the air stream passing through said housing for directing or dispersing the stream of bubbles away from said housing.

29. The bubble machine of claim 28, including an adjustable outlet door movably connected to said housing for directing the stream of bubbles into said additional air stream.

* * * * *